US008993889B2

(12) United States Patent
Barbera

(10) Patent No.: US 8,993,889 B2
(45) Date of Patent: Mar. 31, 2015

(54) OIL SMELTER CABLE

(75) Inventor: Simon Barbera, Valencia (VE)

(73) Assignee: General Cable Technologies Corporation, Highland Heights, KY (US)

( * ) Notice: Subject to any disclaimer, the term of this patent is extended or adjusted under 35 U.S.C. 154(b) by 309 days.

(21) Appl. No.: 13/475,531

(22) Filed: May 18, 2012

(65) Prior Publication Data

US 2013/0306347 A1 Nov. 21, 2013

(51) Int. Cl.

| | |
|---|---|
| ***H01B 7/18*** | (2006.01) |
| ***E21B 36/04*** | (2006.01) |
| ***H05B 3/56*** | (2006.01) |

(52) U.S. Cl.

CPC *H01B 7/18* (2013.01); *E21B 36/04* (2013.01); *H05B 3/56* (2013.01); *H05B 2214/03* (2013.01)

USPC ..... 174/102 R; 174/105 R; 174/106 R; 174/113 R

(58) Field of Classification Search

CPC ..... H01B 1/00; H01B 3/00; H01B 5/00; H01B 7/00; H01B 9/00; H01B 11/00; H01B 12/00; H01B 15/00; H01B 17/00; H01B 19/00; H01R 14/00; H01R 9/00; H01R 11/00; H01R 12/00; H01R 13/00; H01R 23/00; H01R 24/00; H01R 25/00; H01R 27/00; H01R 29/00; H01R 31/00; H01R 33/00; H01R 35/00; H01R 39/00; H01R 41/00; H01R 43/00; H02G 1/00

USPC ..... 174/102 R, 105 R, 106 R, 113 R, 103, 174/106 SC, 117 R, 117 F, 117 FF

See application file for complete search history.

(56) References Cited

U.S. PATENT DOCUMENTS

| | | | | |
|---|---|---|---|---|
| 2,531,917 | A * | 11/1950 | Sorensen Mollerhoj Johannes et al. | 174/13 |
| 4,081,602 | A * | 3/1978 | Paniri et al. | 174/103 |
| 4,284,841 | A * | 8/1981 | Tijunelis et al. | 174/103 |
| 4,315,099 | A * | 2/1982 | Gerardot et al. | 174/47 |
| 4,449,013 | A * | 5/1984 | Garshick | 174/103 |
| 4,515,993 | A * | 5/1985 | MacKenzie | 174/102 R |
| 4,525,598 | A * | 6/1985 | Tsukamoto et al. | 174/128.1 |
| 4,600,805 | A * | 7/1986 | Glynn et al. | 174/102 R |
| 4,749,823 | A * | 6/1988 | Ziemek et al. | 174/103 |
| 4,791,246 | A * | 12/1988 | Neuroth | 174/102 R |
| 5,310,964 | A * | 5/1994 | Roberts et al. | 174/121 A |
| 5,384,430 | A * | 1/1995 | Anthony et al. | 174/115 |
| 5,782,301 | A | 7/1998 | Neuroth et al. | |
| 6,179,269 | B1 * | 1/2001 | Kobylinski | 254/134.3 R |
| 6,555,752 | B2 * | 4/2003 | Dalrymple et al. | 174/102 R |

FOREIGN PATENT DOCUMENTS

| | | |
|---|---|---|
| RU | 16220 | 12/2000 |
| RU | 20697 | 11/2001 |

OTHER PUBLICATIONS

Schedrina, O.; International Search Report and Written Opinion of the International Searching Authority, issued in International Application No. PCT/US2013/040550; dated as mailed on Aug. 22, 2013; 5 pages.

* cited by examiner

*Primary Examiner* — William H Mayo, III

(74) *Attorney, Agent, or Firm* — Ulmer & Berne LLP

(57) ABSTRACT

An oil smelter cable has a plurality of conductor assemblies. Each conductor assembly includes a galvanized steel conductor, an insulation layer that surrounds the galvanized steel conductor, and a metal sheath that surrounds the insulation layer. An armor layer surrounds the plurality of conductor assemblies.

6 Claims, 1 Drawing Sheet

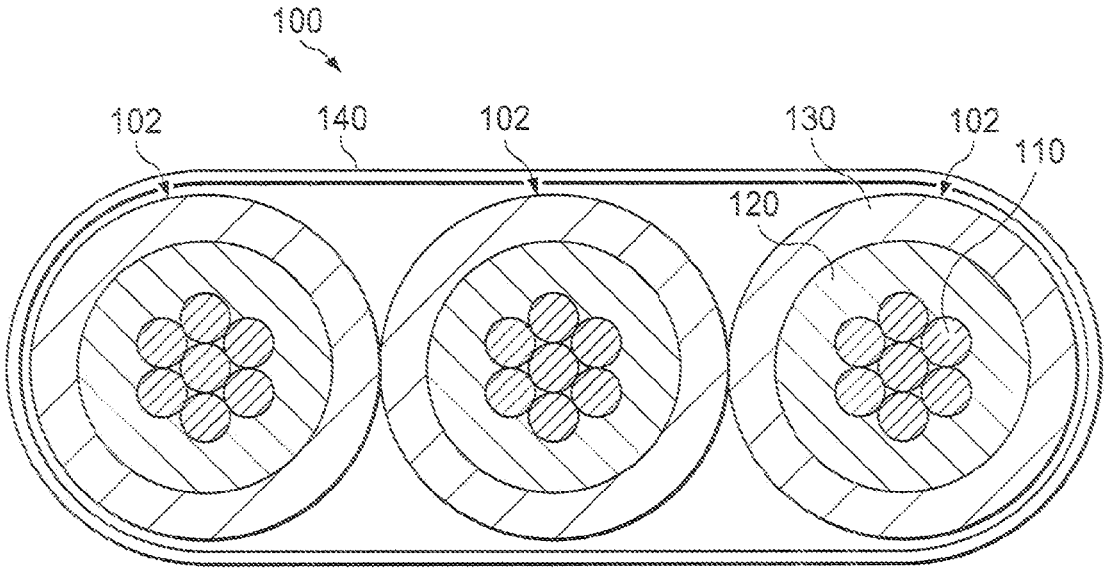
100
102
140
102
130
102
110
120

OIL SMELTER CABLE

FIELD OF THE INVENTION

The present application relates to an oil smelter cable for facilitating the transfer of oil to the surface.

BACKGROUND OF THE INVENTION

Wells are conventionally used to extract oil to the surface. A conventional oil well generally includes wellbores with electrical submersible pumps and production tubing that transfers the oil to the surface where a wellhead is located. A flowline extends from the wellhead for the transmission of the oil. To facilitate flow of the oil up to the surface, a heater cable that extends through the wellhead and down the well along its tubing is often used. U.S. Pat. No. 5,782,301 to Neuroth et al., the subject matter of which is herein incorporated by reference, discloses a conventional heater cable.

The components that make up conventional heater cables are often expensive. Therefore, there is a need for an oil smelter cable that is less expensive than the conventional heater cables.

SUMMARY OF THE INVENTION

Accordingly, the present invention provides an oil smelter cable that comprises a plurality of conductor assemblies. Each conductor assembly includes a galvanized steel conductor, an insulation layer that surrounds the galvanized steel conductor, and a metal sheath that surrounds the insulation layer. An armor layer surrounds the plurality of conductor assemblies.

The present invention may also provide an oil smelter cable that consists of a first, second and third conductor assemblies. Each conductor assembly consists of a galvanized steel conductor, an insulation layer that surrounds the galvanized steel conductor, and a metal sheath that surrounds the insulation layer. An armor layer surrounds the first, second, and third conductor assemblies.

The present invention yet further provides an oil smelter cable that comprises a plurality of conductor assemblies. Each conductor assembly includes a galvanized steel conductor, a polymer insulation layer that surrounds the galvanized steel conductor, and a lead sheath that surrounds the polymer insulation layer. A galvanized steel tape is wrapped around the plurality of conductor assemblies.

Other objects, advantages and salient features of the invention will become apparent from the following detailed description, which, taken in conjunction with the annexed drawings, discloses a preferred embodiment of the present invention.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying FIG. 1, which is a cross-sectional view of a cable in accordance with an embodiment of the present invention.

DETAILED DESCRIPTION OF THE EXEMPLARY EMBODIMENTS

Figure 1:
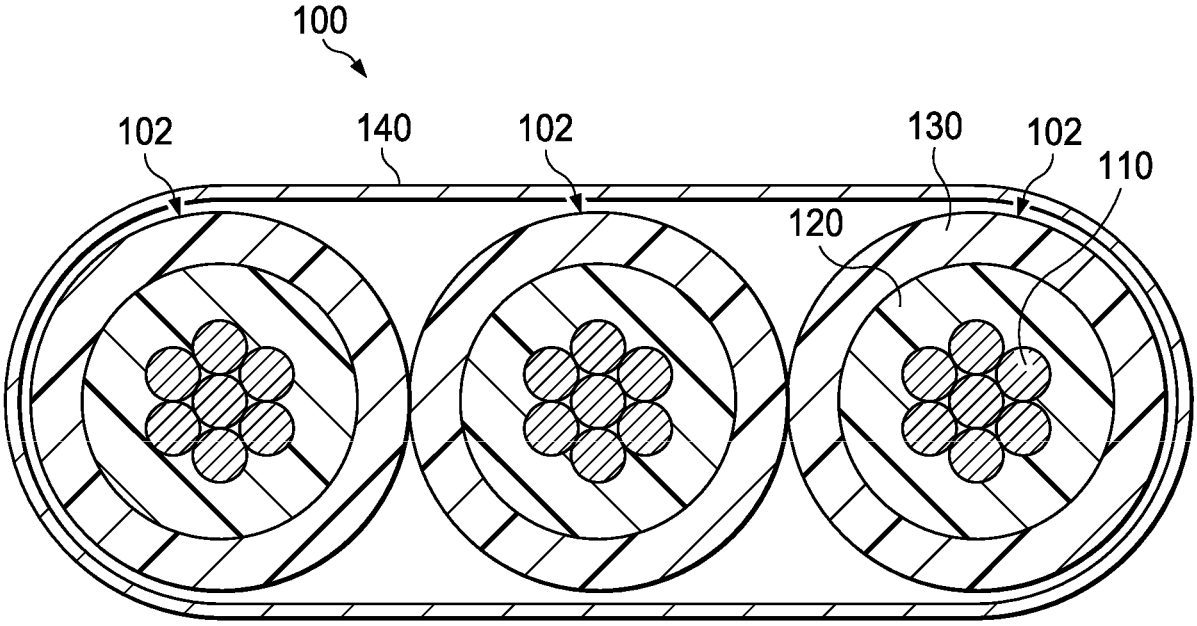

Referring to FIG. 1, the present invention provides an oil smelter cable 100 that requires less expensive materials and fewer components than the prior art cables. The cable 100 generally includes a plurality of conductor assemblies 102 that each includes a conductor 110, an insulation layer 120 surrounding the conductor 110, and a metal sheath 130 surrounding each insulation layer 120. No other components, such as braids, are needed. The conductors 110 are preferably stranded conductors. The conductor assemblies 102 are arranged in a substantially parallel or side-by-side relationship to one another and an outer armor 140 surrounds the conductor assemblies 102. The cable 100 is preferably of a flat type and each conductor assembly 102 has a substantially circular cross-sectional shape. In a preferred embodiment, the cable 100 includes three conductor assemblies 102.

The conductors 110 are made of a suitably high electrical resistivity conduct, preferably galvanized steel. The galvanized steel is significantly less expensive than conventional copper conductors. The electrically insulated conductors 110 are connected to a power source, which preferably supplies three-phase electrical current down conductors 110.

The insulation layer 120 surrounding each conductor 110 is preferably a high temperature tolerant electrical insulation. The insulation layer 120 is preferably formed of Ethylene-Propylene-Diene-Monomer (EPDM). Alternately, the insulation layer 120 may be formed of fluorinated ethylene propylene (FEP), polyterrafluoroethylene (PTFE), or polyvinylidine fluoride (PVDF), Fluoroelastomers, TPOs, and the like.

The protective metal sheaths 130 are preferably extruded over each insulation layer 120. The metal sheaths 130 are preferably made of a material which is a good thermal conductor and provides protection against damage to the electrical insulation layers. For example, the metal sheaths 130 may be formed of lead or a lead alloy. To enhance heat conduction, the metal sheaths 130 may be in physical contact with each other.

The armor 140 is a metal tape, preferably formed of galvanized steel, that is wrapped around the conductors 102 in a conventional manner for an electric power cable. The armor 140 is a good heat conductor. Heat conduction is also facilitated by metal-to-metal contact with the metal sheaths 130.

In operation, power is supplied to the conductors 110 of the conductor assemblies 102 and heat is generated within conductors 110 because of high current flow and resistivity of conductors. The heat passes through the insulation layers 120 and into the lead sheaths 130. The heat transmits readily through the lead sheaths 130 and out to the armor 140. Oil flowing through tubing of the well is therefore heated by the cable 100.

While a particular embodiment has been chosen to illustrate the invention, it will be understood by those skilled in the art that various changes and modifications can be made therein without departing from the scope of the invention as defined in the appended claims.

What is claimed is:

1. An oil smelter cable, consisting of:

first, second, and third conductor assemblies, each conductor assembly consisting of, a galvanized steel conductor, an insulation layer surrounding said galvanized steel conductor, and a metal sheath surrounding said insulation layer; and an armor layer surrounding said first, second, and third conductor assemblies.

2. An oil smelter cable according to claim 1, wherein said insulation layer is formed of EPDM.

3. An oil smelter cable according to claim 1, wherein said metal sheath is formed of lead.

4. An oil smelter cable according to claim 1, wherein said armor layer is a tape wrapped around said first, second, and third conductor assemblies.

5. An oil smelter cable according to claim 1, wherein said first, second, and third conductor assemblies are disposed in a side-by-side arrangement.

6. An oil smelter cable according to claim 1, wherein each of said first, second, and third conductor assemblies has a substantially circular cross-section.

* * * * *

UNITED STATES PATENT AND TRADEMARK OFFICE

CERTIFICATE OF CORRECTION

PATENT NO. : 8,993,889 B2
APPLICATION NO. : 13/475531
DATED : March 31, 2015
INVENTOR(S) : Simon Barbera It is certified that error appears in the above-identified patent and that said Letters Patent is hereby corrected as shown below:

On the title page showing the illustrative figure should be deleted to be replaced with the attached title page.

Replace FIG. 1 with "Replacement Sheet" of FIG. 1, as attached herewith.

Signed and Sealed this
Seventeenth Day of May, 2016

Michelle K. Lee

Michelle K. Lee
*Director of the United States Patent and Trademark Office*

(12) United States Patent
Barbera

(10) Patent No.: US 8,993,889 B2
(45) Date of Patent: Mar. 31, 2015

(54) OIL SMELTER CABLE

(75) Inventor: Simon Barbera, Valencia (VE)

(73) Assignee: General Cable Technologies Corporation, Highland Heights, KY (US)

( * ) Notice: Subject to any disclaimer, the term of this patent is extended or adjusted under 35 U.S.C. 154(b) by 309 days.

(21) Appl. No.: 13/475,531

(22) Filed: May 18, 2012

(65) Prior Publication Data

US 2013/0306347 A1 Nov. 21, 2013

(51) Int. Cl.

| | |
|---|---|
| ***H01B 7/18*** | (2006.01) |
| ***E21B 36/04*** | (2006.01) |
| ***H05B 3/56*** | (2006.01) |

(52) U.S. Cl.

CPC *H01B 7/18* (2013.01); *E21B 36/04* (2013.01); *H05B 3/56* (2013.01); *H05B 2214/03* (2013.01)

USPC ..... 174/102 R; 174/105 R; 174/106 R; 174/113 R

(58) Field of Classification Search

CPC ..... H01B 1/00; H01B 3/00; H01B 5/00; H01B 7/00; H01B 9/00; H01B 11/00; H01B 12/00; H01B 15/00; H01B 17/00; H01B 19/00; H01R 14/00; H01R 9/00; H01R 11/00; H01R 12/00; H01R 13/00; H01R 23/00; H01R 24/00; H01R 25/00; H01R 27/00; H01R 29/00; H01R 31/00; H01R 33/00; H01R 35/00; H01R 39/00; H01R 41/00; H01R 43/00; H02G 1/00

USPC ..... 174/102 R, 105 R, 106 R, 113 R, 103, 174/106 SC, 117 R, 117 F, 117 FF

See application file for complete search history.

(56) References Cited

U.S. PATENT DOCUMENTS

| | | | | |
|---|---|---|---|---|
| 2,531,917 | A * | 11/1950 | Sorensen Mollerhoj Johannes et al. | 174/13 |
| 4,081,602 | A * | 3/1978 | Paniri et al. | 174/103 |
| 4,284,841 | A * | 8/1981 | Tijunelis et al. | 174/103 |
| 4,315,099 | A * | 2/1982 | Gerardot et al. | 174/47 |
| 4,449,013 | A * | 5/1984 | Garshick | 174/103 |
| 4,515,993 | A * | 5/1985 | MacKenzie | 174/102 R |
| 4,525,598 | A * | 6/1985 | Tsukamoto et al. | 174/128.1 |
| 4,600,805 | A * | 7/1986 | Glynn et al. | 174/102 R |
| 4,749,823 | A * | 6/1988 | Ziemek et al. | 174/103 |
| 4,791,246 | A * | 12/1988 | Neuroth | 174/102 R |
| 5,310,964 | A * | 5/1994 | Roberts et al. | 174/121 A |
| 5,384,430 | A * | 1/1995 | Anthony et al. | 174/115 |
| 5,782,301 | A | 7/1998 | Neuroth et al. | |
| 6,179,269 | B1 * | 1/2001 | Kobylinski | 254/134.3 R |
| 6,555,752 | B2 * | 4/2003 | Dalrymple et al. | 174/102 R |

FOREIGN PATENT DOCUMENTS

| | | |
|---|---|---|
| RU | 16220 | 12/2000 |
| RU | 20697 | 11/2001 |

OTHER PUBLICATIONS

Schedrina, O.; International Search Report and Written Opinion of the International Searching Authority, issued in International Application No. PCT/US2013/040550; dated as mailed on Aug. 22, 2013; 5 pages.

* cited by examiner

*Primary Examiner* William H Mayo, III

(74) *Attorney, Agent, or Firm* — Ulmer & Berne LLP

(57) ABSTRACT

An oil smelter cable has a plurality of conductor assemblies. Each conductor assembly includes a galvanized steel conductor, an insulation layer that surrounds the galvanized steel conductor, and a metal sheath that surrounds the insulation layer. An armor layer surrounds the plurality of conductor assemblies.

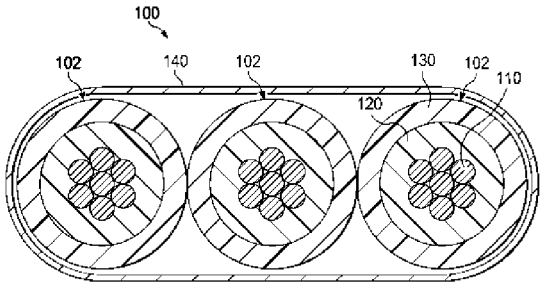

6 Claims, 1 Drawing Sheet